US006758378B2

(12) United States Patent
Carmichael

(10) Patent No.: US 6,758,378 B2
(45) Date of Patent: Jul. 6, 2004

(54) MULTI-PURPOSE HANGER

(76) Inventor: David Carmichael, 621 Penn National Rd., Seffner, FL (US) 33584

( * ) Notice: Subject to any disclaimer, the term of this patent is extended or adjusted under 35 U.S.C. 154(b) by 0 days.

(21) Appl. No.: 10/075,755

(22) Filed: Feb. 14, 2002

(65) Prior Publication Data

US 2002/0108976 A1 Aug. 15, 2002

Related U.S. Application Data

(60) Provisional application No. 60/268,788, filed on Feb. 14, 2001.

(51) Int. Cl.[7] ..... A41D 27/22
(52) U.S. Cl. ..... 223/85; 223/94
(58) Field of Search ..... 223/85, 88, 89, 223/90, 91, 92, 93, 94, 95, 96

(56) References Cited

U.S. PATENT DOCUMENTS 4,978,043 A * 12/1990 Uke ..... 223/88
5,476,199 A * 12/1995 Halverson et al. ..... 223/94
5,480,075 A * 1/1996 Robinson ..... 223/88
6,068,166 A * 5/2000 Kilian et al. ..... 223/94

OTHER PUBLICATIONS

Amico, 1999 Product Catalog, p. 18.
Innovative Scuba Concepts, 2001 Product Catalog, p. 30.
A–Plus Marine Supply, Inc., 2001 Product Catalog, p. 30.
Trident Diving Equipment, 2001 Product Catalog, p. 19.
Rodale's Scuba Diving, Mar. 2002 Catalog, pp. 52–53.

* cited by examiner

*Primary Examiner*—John J. Calvert
*Assistant Examiner*—James G Smith
(74) *Attorney, Agent, or Firm*—Artz & Artz, PC

(57) ABSTRACT

A multi-purpose hanger includes a hook portion for supporting the hanger. The hanger has a pair of opposing shoulder portions extending outwardly from the hook portion. Each of the shoulder portions has a detachable end piece in communication therewith. Each of the end pieces can be attached to their respective shoulder portions such that the end is pointed either upwardly or downwardly as required.

21 Claims, 4 Drawing Sheets

MULTI-PURPOSE HANGER

CROSS REFERENCE TO RELATED APPLICATIONS

The present invention claims priority from U.S. Provisional Application Serial No. 60/268,788, filed Feb. 14, 2001, and entitled "Combination BCD/Wetsuit Hanger."

TECHNICAL FIELD

The present invention relates generally to multi-purpose hangers, and more particularly, to multi-purpose hangers that are capable of retaining both equipment and heavy apparel.

BACKGROUND OF THE INVENTION

Hangers and their configurations are well known for holding a variety of different items. Typical hangers have a hook portion for engaging a hanging rod and a hanging portion that extends generally outwardly in either direction from the hook portion. The hanging portion of these hangers is typically intended to reside within a garment and engage the inner shoulder portion to support the piece of apparel. These types of hangers take on a variety of configurations and are used in a multitude of industries.

Hangers of various types are also used in a variety of industries for different purposes. Many industries require multiple hangers for hanging different types of items. For example, in the dive industry, multiple hangers are especially utilized by scuba divers and the like, to hang their wetsuits and like apparel. Divers that typically own wetsuits also commonly own other dive gear, including buoyancy compensation devices and other dive equipment. The typical hangers that are used to hang wetsuits and other apparel have a hanging portion that is angled slightly downward in either direction from the hook portion. Alternatively, other typical hangers have a hanging portion that is disposed generally horizontal to the ground in either direction with end portions that are directed or curved downward. The configuration of these hangers is intended to match the contour of the shoulder portion of garments, such as wetsuits, jackets or other apparel.

However, these hangers with end portions associated with the hanging portion that are generally horizontal, angled slightly downward or that curve downward are not readily able to hang and support other dive equipment, including buoyancy compensation devices. Thus, a separate hanger must be purchased and utilized to hang this dive equipment. These hangers have end portions that extend upward from either shoulder portion. Therefore, one hanger is needed to hang a wetsuit and another separate hanger is needed to hang other dive equipment. The same applies equally to other industries that utilize both heavy apparel and equipment, including fire fighters, police, military, and EMS.

Obviously, the necessity of two separate hangers is undesirable as it increases the cost, in addition to increasing the required storage space.

SUMMARY OF THE INVENTION

It is therefore an object of the present invention to provide a multi-purpose hanger that is configurable to hold both apparel and associated gear of an individual It is a related object of the present invention to provide a multi-purpose hanger that is configurable to hold both dive apparel and associated dive gear.

It is a further related object of the present invention to provide a multi-purpose hanger that is configurable to hold both a wetsuit and a buoyancy compensation device.

It is another object of the present invention to provide a multi-purpose hanger for heavy apparel with wider shoulders that minimizes creasing.

It is still another object of the present invention to provide a heavy duty hanger that is applicable to heavy duty apparel and equipment for a wide variety of industries and applications.

In accordance with the above and the other objects of the present invention, a multi-purpose hanger is provided. The hanger includes a hook portion that is intended to communicate with another structure to support the hanger in a hanging position. The hook portion has a pair of opposing shoulder portions that extend outwardly therefrom. At least one of the pair of opposing shoulder portions has at least one removable end piece attached thereto. The at least one removable end piece can engage the shoulder portion in a first position where the end piece extends generally downwardly to allow the hanger to accommodate a piece of apparel. The at least one removable end piece can engage the shoulder portion in a second position where the end piece has a portion that extends generally upwardly to allow the hanger to retain at least one piece of equipment thereon.

These and other objects of the present invention will become apparent from the following description of the invention when viewed in accordance with the accompanying drawings and appended claims.

DETAILED DESCRIPTION OF THE PREFERRED EMBODIMENT

Figure 1:
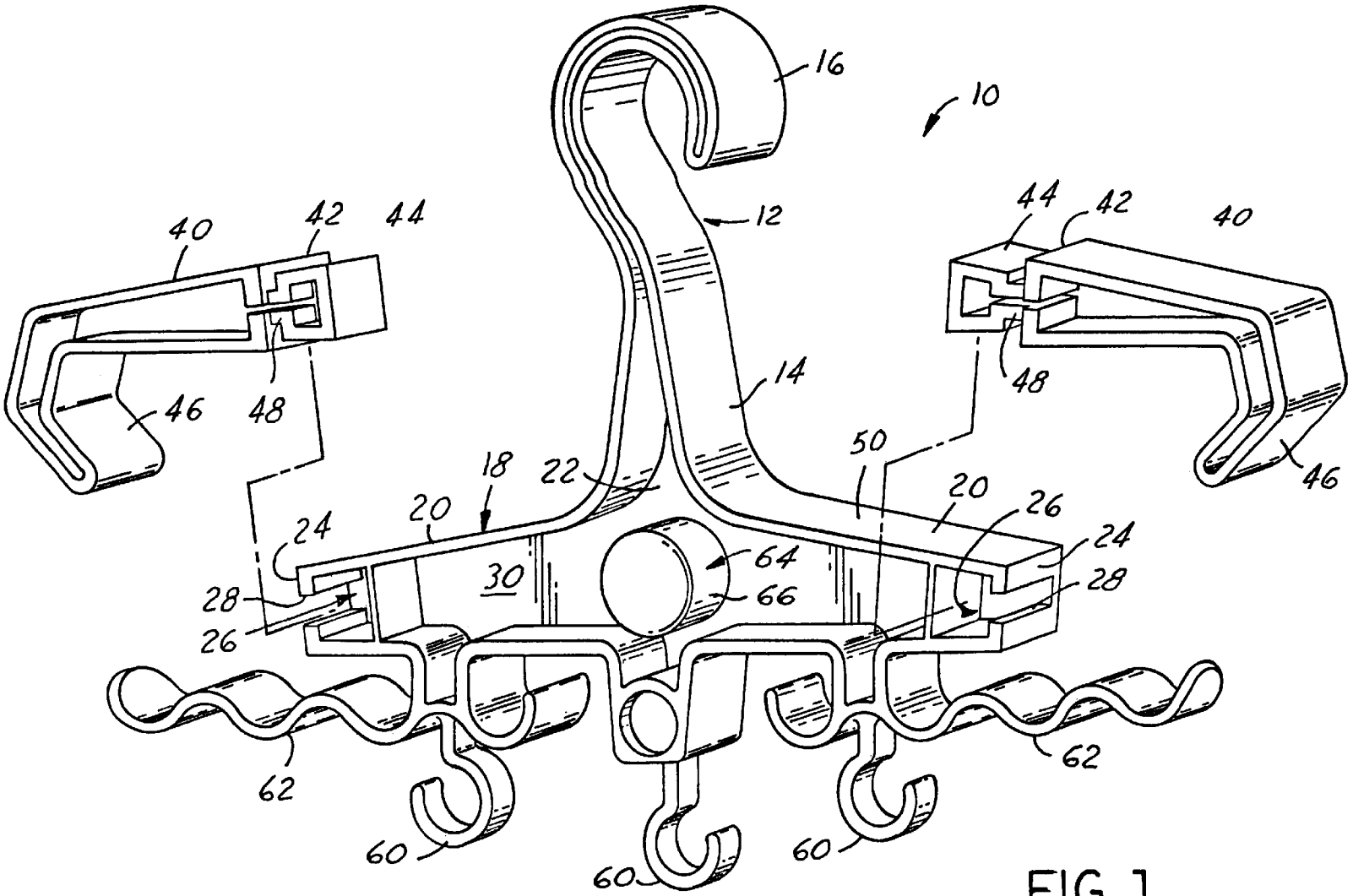
FIG. 1 is an exploded view of a multi-purpose hanger in accordance with a preferred embodiment of the present invention.

Referring now to the Figures which illustrate a multi-purpose hanger 10 in accordance with the present invention. FIG. 1 is an exploded view illustrating the various components of the hanger 10 in accordance with the present invention. The disclosed hanger 10 is preferably for use in the dive industry, however, it is applicable to a wide variety of industries for a wide range of applications. In the position shown in FIG. 2, the hanger 10 is preferably for use as a hanger for wet suits, dry suits, heavy jackets, gloves, boots, hoses, belts, regulators, or other suitable apparel in other industries. The dive industry as broadly used herein includes scuba diving, snorkeling and a variety of other water sports where water apparel and equipment can be utilized.

Figure 3:
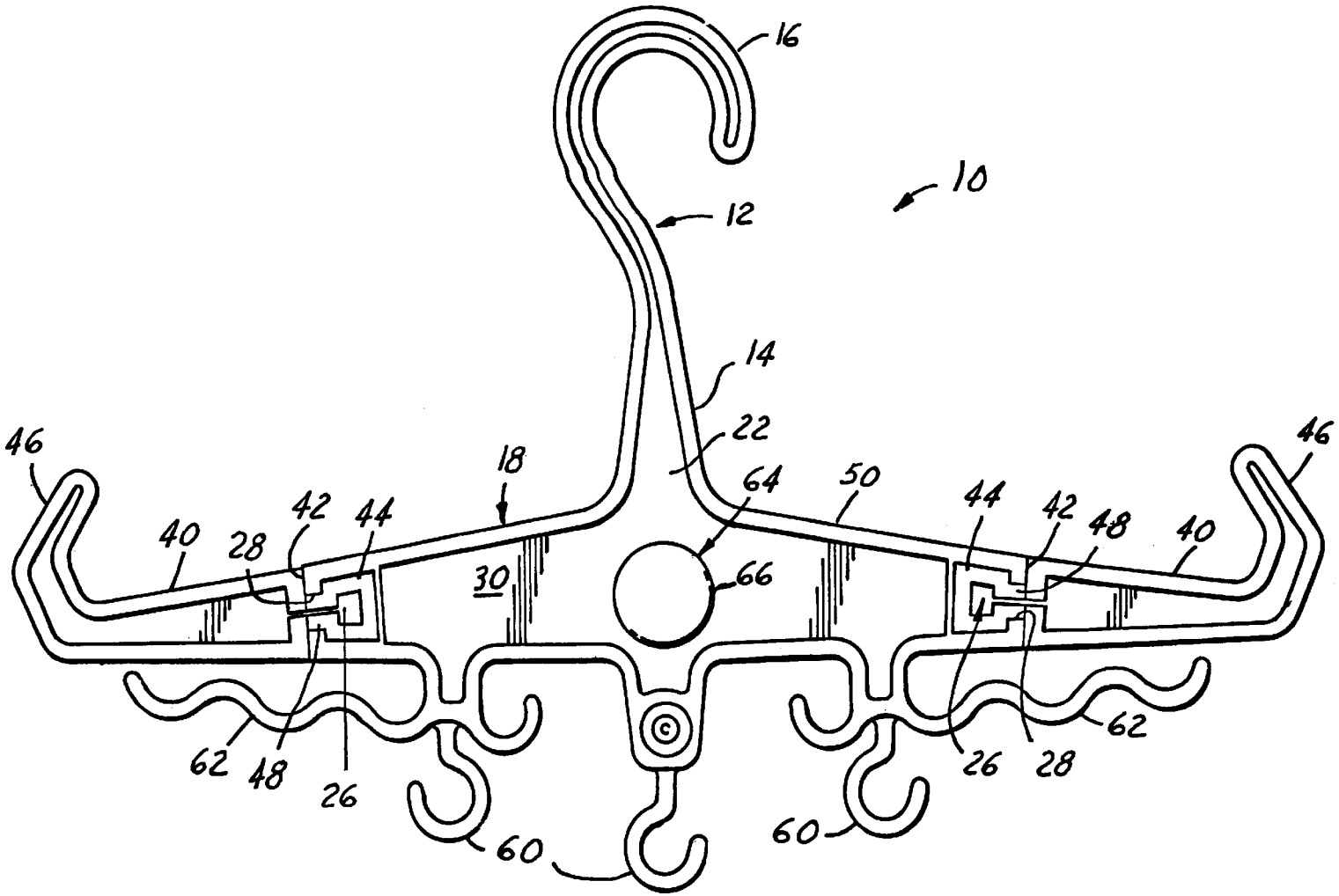
FIG. 3 is a rear plan view of a multi-purpose hanger configured for retaining equipment in accordance with a preferred embodiment of the present invention.
Figure 4:
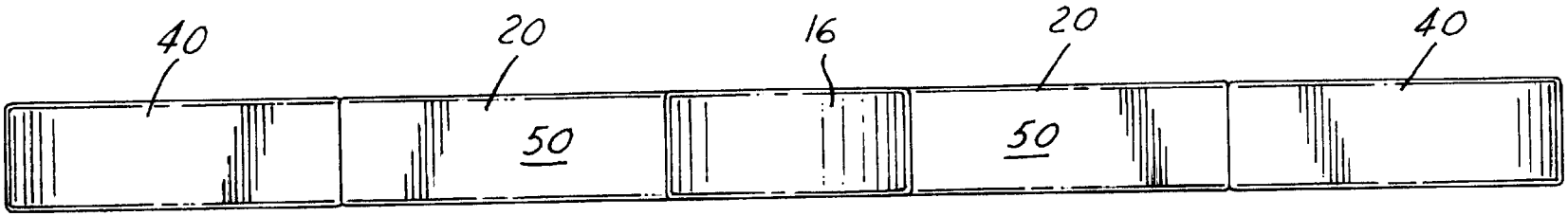
FIG. 4 is a top plan view of a multi-purpose hanger in accordance with a preferred embodiment of the present invention.

When configured as shown in FIG. 3, the hanger 10 is preferably for use as a hanger for dive equipment, such as buoyancy compensation devices or other heavy or load bearing equipment in a variety of industries including technical equipment vests, load bearing equipment, bulletproof vests, fire fighters suspended trousers, safety vests, life vests, flight vests, parachutes, and backpacks. It will be appreciated that the disclosed hanger can have a variety of applications in a variety of different industries. It will also be understood that the disclosed hanger 10 can be utilized to hang or retain a wide variety of other apparel or equipment.

Moreover, it will be appreciated that because of the heavy duty nature of the hanger 10, disclosed herein, it can be utilized for a variety of applications that require such robustness, including the military, police departments, fire departments, and EMS for many of the exemplary applications discussed above. Obviously, the disclosed hanger can be used with a wide variety of other equipment and apparel to provide support with deformation of the hanger 10.

The hanger 10 is preferably constructed of a plastic material and is preferably formed through injection molding processes. However, the hanger 10 may be formed of other suitable materials and may be formed by a variety of other suitable methods or processes. The hanger 10 includes an upper portion 12 having a neck portion 14 and a hook portion 16. The hook portion 16 is configured as a "hook-like" structure so as to engage a bar, hook or other retaining structure. The hanger 10 also includes a lower portion 18 having a pair of shoulder portions 20 that extend away from a junction 22 where the upper portion 12 and the lower portion 14 are joined.

Each of the pair of shoulder portions 20 has an outer end 24 disposed away from the junction 22. Each of the outer ends 24 has a cavity 26 formed adjacent thereto in one side 30 thereof. The other side 32 of the hanger 10 preferably has a ridge 31 formed thereon, i.e., without any cavities. Each of the outer ends 24 has an opening 28 formed therein. Each of the pair of shoulder portions 20 is intended to engage a respective end piece 40, with each of the end pieces 40 having an inner end portion 42 that abuts a respective one of the outer ends 24.

Each of the end pieces 40 is a separate removable piece and includes a locking portion 44 that extends from the inner end portion 42 and a hooked outer member 46 located opposite the inner end portion 42. Each of the locking portions 44 preferably includes a narrow neck portion 48 that extends between the locking portion 44 and the inner end portion 42. To attach each of the end pieces 40 to a respective one of the shoulders 20, the locking portions 44 are placed into a respective one of the cavities 26 with the narrow neck portion 48 extending through the associated opening 28. Each of the locking portions 44 is larger than the associated opening 28 in the outer ends 24 in order to retain the end pieces 40 to the respective shoulder portions 20 against any pulling force. The end pieces 40 can be removed by sliding them out of their respective cavity 26.

Figure 2:
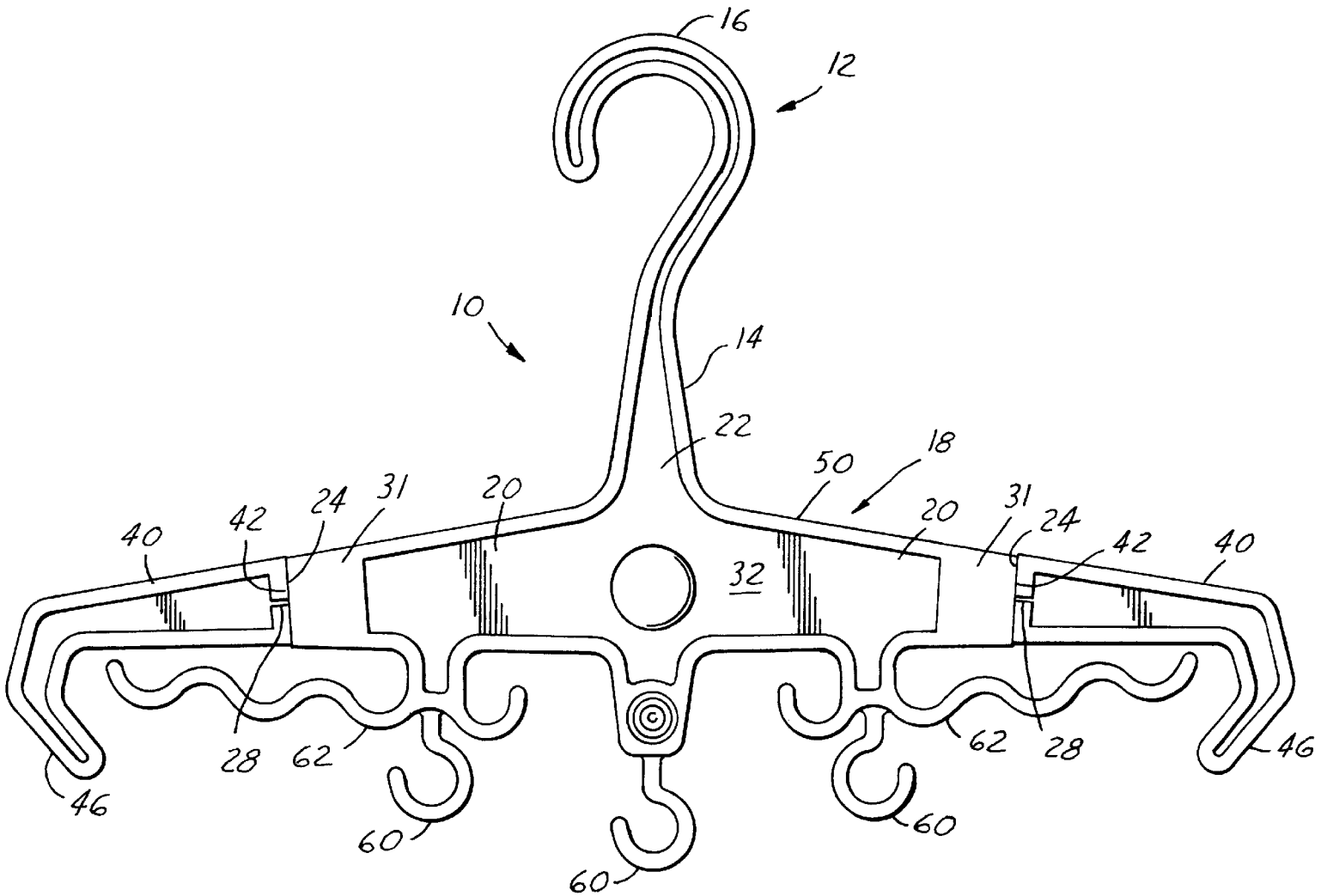
FIG. 2 is a front plan view of a multi-purpose hanger configured for hanging apparel in accordance with a preferred embodiment of the present invention.

The end pieces 40 are reversible such that, as shown in FIG. 2, they can be attached to the shoulders 20 with the hooked outer ends 46 pointing or directed downwards. With this configuration, the hanger 10 can be utilized to hang a wetsuit, dry suit or outer suitable piece of apparel, as described above. Further, the hanger 10 is preferably sized such that each of the shoulder portions has a larger width, i.e., the distance between the first side 30 and the second side 32 of the hanger, in order to minimize wetsuit crease. The shoulders 20 preferably have an upper surface 50 that is generally planar and is thus wider than current hangers. The increased width provides necessary structural support for heavy duty apparel and garments. In one example, the width of the upper surface 50 is approximately 1⅛ inches, however, other suitable width may be utilized.

As shown in FIG. 3, the end pieces 40 can be attached to the shoulders 20 with the hooked outer ends 46 pointed or directed upwards. With this configuration, the hanger 10 can be utilized to hang or retain buoyancy compensation devices or other equipment by containing the straps of those devices on the shoulders 20 of the hanger 10 with the hooked outer ends 46 preventing the straps from slipping off the hanger 10.

The hanger 10 also includes a plurality of downwardly extending hooks 60. The downwardly extending hooks 60 allow the hanger 10 to hold a variety of other accessories thereon, including boots, gloves, fins, snorkels, hoses, belts, and regulators. A variety of other accessories can be attached to the hooks. Additionally, a pair of clamps 62 are formed below the lower portion 18 and extend generally parallel to ground to provide additional attachments for further accessories. Further, the hanger 10 also includes a dim valve holder 64. The dim valve holder 64 has a cap 66 that is attached thereto, such as by a threaded securing means to maintain the dim valve therein.

It is to be understood that the preceding description of the preferred embodiment is merely illustrative of some of the many specific embodiments that represent applications of the principles of the present invention. Numerous and other arrangements would be evident to those skilled in the art without departing from the scope of the invention as defined by the following claims.

What is claimed is:

1. A multi-purpose hanger, comprising:

a hook portion that is intended to engage a structure allowing the hanger to hang;

a pair of opposing shoulder portions extending generally outwardly from said hook portion;

at least one end piece that is releasably engageable with one of said pair of opposing shoulder portions such that said at least one end piece can engage said one of said pair of opposing shoulder portions in a first position and a second position; and said at least one end piece having an end portion that is configurable in said first position to allow apparel to rest on said pair of shoulder portions and in said second position to allow at least one piece of equipment to be retained by said end portion.

2. The hanger of claim 1, wherein in said first position, said end portion is pointed in a generally downward direction.

3. The hanger of claim 2, wherein in said second position, said end portion is pointed in a generally downward direction.

4. The hanger of claim 1, further comprising:

a pair of end pieces each releasably engageable with a respective one of said pair of opposing shoulder portions.

5. The hanger of claim 1, further comprising:

a plurality of generally downwardly extending hooks that are intended to retain one or more accessories.

6. The hanger of claim 5, wherein said at least one end piece includes a locking portion that is intended to secure said at least one end piece to said one of said pair of shoulder portions.

7. The hanger of claim 6, wherein said one of said pair of shoulder portions has a cavity formed therein for receipt of said locking portion.

8. The hanger of claim 1, wherein each of said shoulder portions have a width sufficient to minimize crease of a wet suit hung thereon.

9. A multi-purpose hanger that is intended to hang both a wetsuit and a buoyancy compensation device, comprising:

an upper hook portion that is intended to engage another structure allowing said upper hook portion to hang;

a pair of opposing shoulder portions integrally formed with said upper hook portion and extending radially outwardly from said upper hook portion; and at least one detachable end piece that is engageable with one of said pair of opposing shoulder portions in both a first position and a second position, said at least one detachable end piece having a hooked end portion that is configured to hang the wetsuit when said at least one end piece engages said one of said pair of opposing shoulder portions in said first position and is configured to hang the buoyancy compensation device when said at least one end piece engages said one of said pair of opposing shoulder portions in said second position.

10. The hanger of claim 9, wherein the hanger is constructed of a plastic material.

11. The hanger of claim 10, wherein in said first position said hooked end portion is directed in a generally downward direction.

12. The hanger of claim 11, wherein in said second position said hooked end portion is directed in a generally upward direction.

13. The hanger of claim 9, further comprising:

a pair of end pieces each releasably engageable with a respective one of said pair of opposing shoulder portions.

14. The hanger of claim 9, further comprising:

at least one accessory hook that is intended to accommodate at least one accessory thereon.

15. The hanger of claim 14, wherein said at least one hook extends generally downward from one of said pair of shoulder portions.

16. The hanger of claim 14, further comprising:

a plurality of generally downwardly extending hooks.

17. The hanger of claim 12, wherein said at least one end piece includes a locking portion that is intended to secure said at least one end piece to said one of said pair of shoulder portions.

18. The hanger of claim 17, wherein said one of said pair of shoulder portions has a cavity formed therein for receipt of said locking portion.

19. The hanger of claim 9, wherein each of said shoulder portions have a width sufficient to minimize wetsuit crease when a wetsuit is hung thereon.

20. A multi-purpose hanger, comprising:

a hook portion that is intended to engage a structure allowing the hanger to hang;

a plurality of opposing shoulder portions extending generally outwardly from said hook portion; and a plurality of end pieces that are each releasably attached to a respective one of said plurality of opposing shoulder portions in a first position and a second position, whereby when said plurality of end pieces are disposed in said first position the hanger can receive apparel thereon and when said plurality of end pieces are attached in said second position the hanger can retain at least one piece of diving equipment thereon.

21. The hanger of claim 20, wherein each of said plurality of opposing shoulder portions is in removable engagement with said respective shoulder portions.

* * * * *